US009038220B2

(12) United States Patent
Aas-Jakobsen et al.

(10) Patent No.: US 9,038,220 B2
(45) Date of Patent: May 26, 2015

(54) SUPPORT PILLOWS

(71) Applicant: BBCOMPANY AS, Oslo (NO)

(72) Inventors: Elisabeth Christina Aas-Jakobsen, Oslo (NO); Ann Kristin Sveinsvoll Homdrum, Sandnes (NO); Hilde Sjo Tavares, Byrne (NO); Marius Andresen, Oslo (NO); Rolf Blomvagnes, Oslo (NO); Kevin Geers, Oslo (NO)

(73) Assignee: BBCOMPANY AS, Oslo (NO)

( * ) Notice: Subject to any disclaimer, the term of this patent is extended or adjusted under 35 U.S.C. 154(b) by 0 days.

(21) Appl. No.: 14/488,341

(22) Filed: Sep. 17, 2014

(65) Prior Publication Data

US 2015/0089742 A1 Apr. 2, 2015

(30) Foreign Application Priority Data

Oct. 1, 2013 (GB) ..... 1317370.3

(51) Int. Cl.

| | |
|---|---|
| ***A47G 9/10*** | (2006.01) |
| *A47C 20/02* | (2006.01) |
| *A47D 13/08* | (2006.01) |

(52) U.S. Cl.

CPC ..... *A47G 9/10* (2013.01); *A47C 20/025* (2013.01); *A47G 9/1045* (2013.01); *A47D 13/083* (2013.01)

(58) Field of Classification Search

CPC ..... A47D 13/083; A47G 9/10; A47G 9/1045
USPC ..... 5/630–632, 636, 640, 490, 491, 498; 24/72.5; 53/138.3, 417, 521, 524
See application file for complete search history.

(56) References Cited

U.S. PATENT DOCUMENTS

| | | | | | |
|---|---|---|---|---|---|
| 3,820,200 | A | * | 6/1974 | Myers | 24/30.5 S |
| 3,962,757 | A | * | 6/1976 | Gedney | 24/562 |
| 4,761,872 | A | * | 8/1988 | Buettner et al. | 29/451 |
| 5,083,555 | A | * | 1/1992 | Lewis | 602/6 |
| 5,584,086 | A | * | 12/1996 | VanWinkle et al. | 5/644 |
| 6,052,848 | A | * | 4/2000 | Kelly | 5/632 |
| 6,088,854 | A | * | 7/2000 | Brownrigg | 5/632 |
| D446,677 | S | * | 8/2001 | Hall et al. | D6/601 |
| 6,457,195 | B1 | * | 10/2002 | Holste | 5/636 |
| 6,641,221 | B1 | | 11/2003 | Kastlunger | |
| 6,711,770 | B1 | | 3/2004 | Owens et al. | |

(Continued)

FOREIGN PATENT DOCUMENTS

| | | | | | |
|---|---|---|---|---|---|
| DE | 4319600 | C1 | * | 12/1994 | A47G 9/00 |
| DE | 29604156 | U | | 5/1996 | |

(Continued)

*Primary Examiner* — Michael Trettel
(74) *Attorney, Agent, or Firm* — Sutherland Asbill & Brennan LLP

(57) ABSTRACT

A support pillow includes a flexible outer sleeve and a deformable inner cushion positioned wholly inside the outer sleeve. Both the outer sleeve and inner cushion are elongate. The outer sleeve is longer than the inner cushion and defines a pair of free end portions extending beyond the inner cushion. The inner cushion is moveable inside the outer sleeve such that the length of each of the free end portions is adjustable. A gripping device can be moved along each end portion to close the outer sleeve around the inner cushion and fix the length of the free end portion extending beyond the inner cushion. The free end portions extend far enough to enable a user to connect the end portions together to fix the support pillow in a desired shape.

19 Claims, 4 Drawing Sheets

(56) References Cited

U.S. PATENT DOCUMENTS

| | | | | |
|---|---|---|---|---|
| 7,536,736 | B1 * | 5/2009 | Martinez | 5/639 |
| 2007/0151031 | A1 | 7/2007 | Leach | |
| 2007/0226909 | A1 * | 10/2007 | Goldman | 5/636 |
| 2010/0175194 | A1 | 7/2010 | Mastrosimone-Gese | |

FOREIGN PATENT DOCUMENTS

| | | | | |
|---|---|---|---|---|
| DE | 29604156 | U1 * | 5/1996 | B68G 11/00 |
| JP | 2003230473 | A | 8/2003 | |
| JP | 2005211625 | A | 8/2005 | |

* cited by examiner

SUPPORT PILLOWS

TECHNICAL FIELD

The present invention relates to support pillows, in particular but not exclusively to support pillows that can be fixed in one or more different shapes to provide for flexibility in use.

BACKGROUND OF THE INVENTION

Traditional pillows used to support the head or other parts of the body, for example used while sleeping, typically have a substantially fixed shape. Although a conventional pillow may contain a deformable cushion, small local changes in the shape of the cushion are usually accommodated within an outer cover that is closed around the inner cushion in a fixed shape. Such pillows are limited in the ways that they can be used. In order to support different bodily positions e.g. sitting, reclining, lying, etc., a user will normally stack multiple pillows at different angles and/or orientations to achieve a desired supporting configuration.

Some pillows have a shape other than the normal square or rectangular shape so as to provide a particular supporting function. For example, elongate pillows that are straight or U-shaped are sold for use by pregnant women. These sausage-like pillows may be used by pregnant women to support their pelvis and baby bump while sleeping. However, even these elongate pillows are fixed in their overall outer dimensions and this limits their ability to adapt to use in different circumstances.

There remains a need for support pillows that can be easily adapted for use in various different situations.

SUMMARY OF THE INVENTION

According to a first aspect of the present invention there is provided a support pillow comprising a flexible outer sleeve and a deformable inner cushion positioned wholly inside the outer sleeve, both the outer sleeve and inner cushion being elongate, wherein the outer sleeve is longer than the inner cushion and defines a pair of free end portions extending beyond the inner cushion, the free end portions extending far enough to enable a user to connect the end portions together to fix the support pillow in a desired shape. Preferably the inner cushion is moveable inside the outer sleeve such that the length of each of the free end portions is adjustable.

Rather than the outer sleeve being closed around the deformable inner cushion to define a fixed shape, the free end portions enable a user to change the overall shape of the support pillow, for example converting a straight sausage shape into an annular donut shape or a horseshoe shape. It will be appreciated that the presence of the free end portions means that the inner cushion can move inside the outer sleeve and the length of each of the end portions can therefore be adjusted. For example, the two free end portions may have different lengths either side of the inner cushion. A user can dictate the overall shape of the support pillow by choosing where to connect together the free end portions, for example tying them close to the inner cushion to form a tighter shape or tying them together further away from the inner cushion to make a looser shape. This determines how loosely or tightly the outer sleeve accommodates the inner cushion. A user may therefore dictate whether the pillow is free to move in a loose shape or whether the pillow is held tightly in a more fixed shape.

By providing the support pillow with a pair of free end portions extending either side of the inner cushion, a user has a large of freedom in deciding how to manipulate the shape of the pillow and connect e.g. tie the end portions to fix the pillow in a desired shape. Pregnant women in particular may find great benefit in being able to convert the support pillow between different shapes. For example, the support pillow may be left with the free end portions not connected together so that it has an elongate e.g. sausage shape that can be used for support while a pregnant woman is resting or sleeping on her side. The elongate shape of the pillow can be used to support her belly and pelvis as well as head and legs. If a pregnant woman prefers to sleep on her front then the free end portions may be connected together to fix the support pillow in a generally annular e.g. donut shape so that the pillow can provide support around the belly with the woman laid on top. A support pillow fixed in an annular shape may also be useful for breastfeeding, for example a woman may wrap the pillow around her torso and connect the free end portions together to form an annular shape that can support a baby while it is feeding. A support pillow fixed around the body may even be used to support other things for convenience of use, for example a tablet computer. Advantageously a user can connect e.g. tie the free end portions together tightly enough that the annular shape stays in place around the torso so that he/she can even stand up and move around while the support pillow stays in position. In another example, the free end portions may be connected together so as to fix the support pillow in a U-shaped form that may be used as a rest for a sleeping baby.

In any of the examples above, it may be particularly convenient for the free end portions to be long enough to enable a user to tie the end portions together. In embodiments of the present invention, it is preferable that each of the free end portions extends beyond the inner cushion for a length of at least 10 cm and preferably at least 20 cm or 30 cm. The free end portions are therefore long enough to enable a user to easily tie the free end portions together.

It may be that the outer sleeve is closed around the inner cushion only by connecting together the two free end portions. In other words, the inner cushion may be entirely loose inside the outer sleeve until the free end portions are connected together. However, this also means that the inner cushion may be free to slide out of the sleeve when the end portions are not connected together. It is preferable for some kind of closure means to be provided. Thus in a preferred set of embodiments the outer sleeve is closeable around the inner cushion to fix a length for each of the free end portions. By using suitable closures, the two free end portions may be fixed so as to have the same or different lengths. Furthermore, by closing the outer sleeve around the inner cushion the manipulability of the pillow is fixed depending on whether the cushion is tightly or loosely contained inside the outer sleeve. Tightly closing the outer sleeve around the inner cushion, which may even act to compress the cushion, will increase the length of the free end portions and make the pillow stiffer. On the other hand, only loosely closing the outer sleeve around the inner cushion may give the cushion more space to move around so that the pillow is overall more flexible, although the free end portions may be reduced in length.

The support pillow may include any suitable closure means for closing the outer sleeve around the inner cushion. For example, this may be achieved simply by tying a knot in the outer sleeve so as to fix a length for one of the free end portions. However it may not be very easy to tighten a knot, for example due to the material of the outer sleeve, and also not easy to undo a knot if it is desired to adjust the length of a free end portion. Preferably the support pillow further comprises closure means for each of the free end portions. In one example, the closure means may comprise a cord or ribbon that can be wrapped around the outer sleeve to fix a desired length for the free end portion. However this may also require a user to tie a knot or bow, which can be fiddly and is not easy to undo. In another example, the closure means may comprise a self-locking cord, e.g. a cord in combination with a cord lock or toggle, so that the cord can be tightened around the outer sleeve without requiring any knots. Such a self-locking cord can be quickly and easily released if it is desired to adjust the position of the closure means.

It is desirable to avoid closure means comprising multiple parts. A preferred closure means will allow for easy manipulation and rapid locking/unlocking to fix the free end portions at a desired length. In one set of embodiments, the support pillow further comprises a gripping device that can be moved along each end portion to close the outer sleeve around the inner cushion and fix the length of the free end portion extending beyond the inner cushion. Such a gripping device is advantageous because it can be quickly and easily moved along a free end portion so as to adjust the closure position and therefore change the shape of the support pillow.

In one set of embodiments the pillow comprises a pair of gripping devices, each gripping device movable along the outer sleeve to independently fix the lengths of the free end portions. In another set of embodiments the pillow comprises a single gripping device moveable along the outer sleeve to simultaneously fix the length of both free end portions. The gripping device(s) may be positioned so as to leave the free end portions long enough that they can be tied together. However, even without being able to tie or otherwise connect the end portions together, such gripping devices can advantageously allow a user to shape the support pillow by making the outer sleeve close more tightly or loosely around the inner cushion.

This is considered novel and inventive in its own right, and thus when viewed from a second aspect, the present invention provides a support pillow comprising a flexible outer sleeve and a deformable inner cushion positioned wholly inside the outer sleeve, both the outer sleeve and inner cushion being elongate, wherein the outer sleeve is longer than the inner cushion and defines a pair of free end portions extending beyond the inner cushion, and further comprising at least one gripping device movable along one or both of the free end portions to close the outer sleeve around the inner cushion and fix a length for the free end portions extending beyond the inner cushion.

It will be appreciated that a support pillow including such gripping device(s) has the advantage that a user can easily move the gripping device(s) to tighten or loosen the outer sleeve around the inner cushion and therefore shape the pillow. The free end portions may not be very long while still achieving such a shaping effect, but preferably the free end portions extend far enough to enable a user to connect e.g. tie the free end portions together to fix the support cushion in a desired shape, as is already described above.

The gripping device(s) may take any suitable form. For example, the at least one gripping device may comprise a clip, such as a U-shaped clip. However it is preferable for the gripping device to comprise a gripping ring, as this may be particularly easy to slide along the outer sleeve and secure at a desired position. The gripping device may comprise a double gripping ring, for example where a single gripping device is used to close the outer sleeve and fix both free end portions using adjacent gripping rings. In addition, or alternatively, each gripping device is preferably self-locking. For example, a gripping ring having a self-locking design may comprise one or more slots. Such a gripping ring may comprise a plurality of radially extending slots. A self-locking gripping device may be formed of a resilient e.g. elastomeric material. A low friction material, such as silicone, may be used so that the gripping ring slips easily over the material of the outer sleeve.

It is preferable that the gripping device(s) can be fully separated from the outer sleeve when not in use. The outer sleeve may therefore be removed from the inner cushion to allow for cleaning.

It is envisaged that the support pillow may comprise one or more further gripping devices, or other constricting means, that are positioned around the inner cushion, rather than the free end portions. Such further constricting means may be used to help shape the pillow by squeezing and deforming the inner cushion. For example, additional gripping device(s) may be moveable along the outer sleeve to compress the inner cushion and change its shape. In other examples, the constricting means may take the form of a tightenable strap or band, which may be moveable along the sleeve or may even be formed on or inside the sleeve to deform the inner cushion at a set position. Of course one or more such straps or bands may be spaced, equally or unequally, along the length of the inner cushion. The further gripping device(s) or constricting means may, for example, at least partially deform the inner cushion into multiple segments e.g. of the same or different lengths. The segmented inner cushion may then be articulated to help fix the pillow in different shapes, for example polygonal rather than rounded shapes.

There will now be described some general features that apply to embodiments of either aspect of the present invention.

The free end portions may be closed, e.g. to form a closed container that is longer than the inner cushion. The free end portions may be permanently closed (e.g. sewn or sealed closed) or they may be temporarily closed by any suitable means e.g. fasteners, buttons, poppers, etc. However, it may be preferable for the free end portions to be open or openable to enable easy removal of the inner cushion, for example for cleaning purposes. The outer sleeve may therefore take the form of an open-ended tube.

It will be understood that both the outer sleeve and inner cushion being elongate means that they have an aspect ratio much greater than one. Preferably the inner cushion and/or outer sleeve are generally cylindrical in shape, so as to make it easy for the inner cushion to slide inside the outer sleeve. However, the inner cushion, and potentially also the outer sleeve, may have any suitable cross-sectional shape including circular, oval, star-shaped, U-shaped, oblong, square, rectangular, triangular, polygonal, etc.

In embodiments of the present invention, the flexible outer sleeve may be made of any suitable material, including plastics e.g. film materials, but a flexible fabric material may be preferred. The fabric material may be made from one or more synthetic and/or natural fibres, such as one or more of: bamboo, cotton, wool, hemp, etc. The fabric material may be made from a mixture of fibres, e.g. natural fibres that may be preferred to contact the skin and synthetic fibres to add properties such as stretch. Preferably the outer sleeve is made from a flexible fabric material that is lightweight and preferably also easy to clean.

The deformable inner cushion may be a solid cushion, for example formed from a block of foam or other deformable material. The solid cushion may be provided with or without its own cover. One or more solid cushions may form the inner cushion, for example multiple cushions may provide an articulated inner cushion. In other examples, the deformable inner cushion may comprise a cover containing a non-continuous e.g. granular or particulate fill material. A wide variety of different fill materials may be used, such as e.g. feathers, fluff, beads (e.g. wooden, plastic, foam such as expanded polystyrene (EPS) foam), grains (natural e.g. wheat, spelt, etc.), textile rags, etc. In other examples the deformable inner cushion may be filled with air rather than a solid or non-continuous fill material. In some examples, the fill material may be separated into compartments e.g. so as to articulate the inner cushion. The compartments may be connected to one another or separately moveable inside the outer cover.

When the free end portions are not in use, the flexibility of the outer sleeve means that the free end portions may be tied up or pushed inside the sleeve so that the support pillow has the same general shape as the inner cushion without any dangling ends. This may be helpful if using the support pillow as a normal pillow e.g. on a couch or bed and/or for storing the pillow when not in use. Since the inner cushion can preferably be freely removed from the outer sleeve, it is also possible for the outer sleeve with the free end portions to be removed and replaced with an alternative sleeve that has dimensions to match the inner cushion and therefore provides for a conventional cover at times when it is not desired to use the shapeabillity of the pillow. The support pillow may be provided as part of a kit further comprising a plurality of outer sleeves, preferably one or more sleeves that are different e.g. in terms of dimensions, fabric, colour and/or pattern, etc. In such a kit, at least one outer sleeve is elongate as described above but other sleeves may have any shape. For example, the kit may include another outer sleeve that is generally round or rectangular in shape, so that the inner cushion is held in a non-elongate shape, and the pillow can be used e.g. as a conventional pillow or poof. The kit may even include another outer sleeve having a particular shape e.g. of an animal, so that the pillow takes on the shape of a toy.

The present invention also extends to a method of shaping a support pillow, the support pillow comprising a deformable inner cushion and a flexible outer sleeve, both the inner cushion and outer sleeves being elongate, wherein the outer sleeve is longer than the inner cushion and defines a pair of free end portions extending beyond the inner cushion, the method comprising: connecting the free end portions together to fix the support pillow in a desired shape. As is discussed above, such a method may comprise fixing the support pillow in any desired shape including an annular e.g. donut shape, a horseshoe shape, a figure-of-eight, etc. The method may comprise tying the free end portions together.

The method may comprise first fixing a length of one or both of the free end portions by closing the outer sleeve around the inner cushion. In one example, this may comprise tying the outer sleeve in a knot e.g. next to the inner cushion. In another example, this may comprise using a gripping device to close the outer sleeve around the inner cushion. Where a gripping device is provided, the method may comprise selectively moving a gripping device along the outer sleeve so as to select a length of a free end portion.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

Some preferred embodiments of the present invention will now be described, by way of example only, and with reference to the accompanying drawings, in which.

DETAILED DESCRIPTION

Figure 1A:
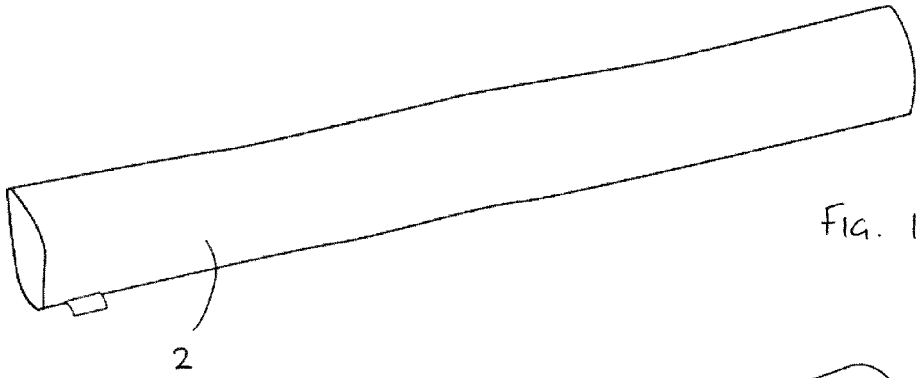
FIGS. 1*a* and 1*b* are perspective views of the outer sleeve and inner cushion, respectively, of a support pillow.
Figure 1B:
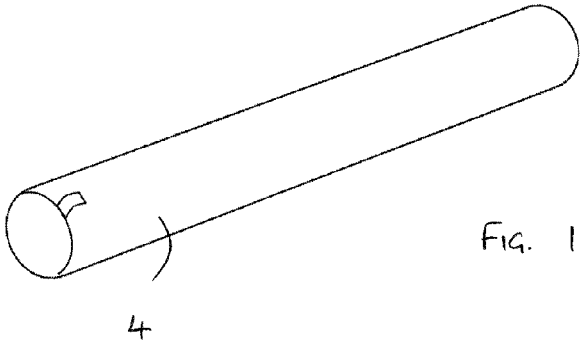
Figure 2A:
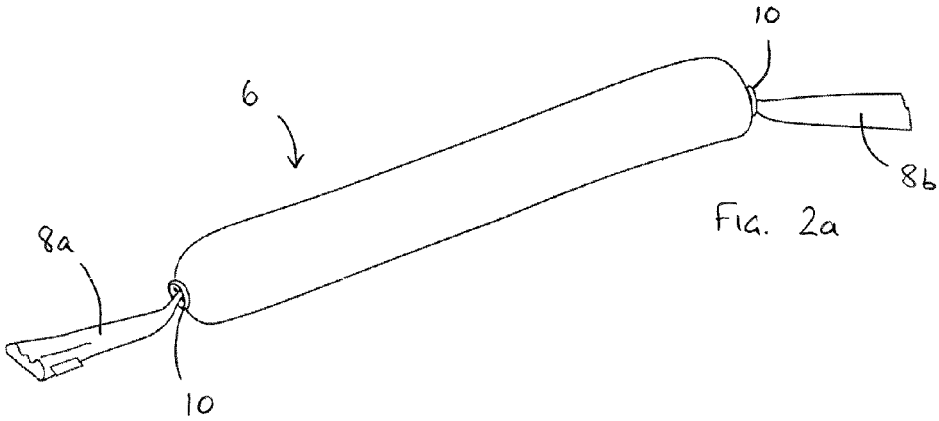
FIG. 2*a* shows an assembled support pillow with free end portions and FIGS. 2*b* and 2*c* provide examples of a gripping device used to fix the free end portions.
Figure 2B:
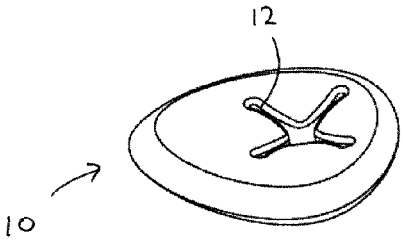

In FIG. 1*a* there is seen a flexible outer sleeve 2 e.g. of fabric material that is in the form of an open-ended tube. FIG. 1*b* shows a deformable inner cushion 4 that may be inserted inside the outer sleeve 2 to form a support pillow. Both the outer sleeve 2 and inner cushion 4 are elongate. The outer sleeve 2 is longer than the inner cushion 4. As is seen from FIG. 2*a*, when the inner cushion 4 is positioned wholly inside the outer sleeve 2, the resulting support pillow 6 has a pair of free end portions 8*a*, 8*b* extending either side of the inner cushion 4. In this example a pair of gripping devices 10, seen more clearly in FIG. 2*b*, are used to close the outer sleeve 2 around the inner cushion 4 and thereby fix a length for each of the end portions 8*a*, 8*b*. In this example, each gripping device 10 has slots 12 arranged in a cross shape through which each of the free end portions 8*a*, 8*b* of the outer sleeve 2 may be threaded. The gripping device 10 is formed from a resilient material such as silicone so that it can deform resiliently as the material of the outer sleeve 2 is pulled through the slots 12.

Figure 2C:
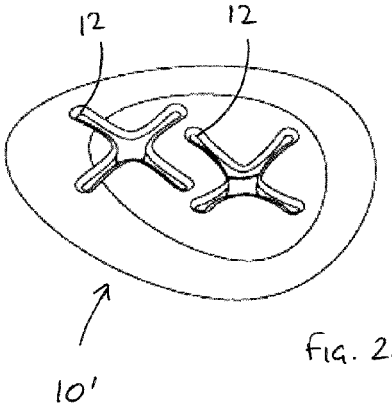

It will be appreciated that a single gripping device 10 may be used to fix the length of both free end portions 8*a*, 8*b* if the support pillow 6 is made into a ring shape. For example, both free end portions 8*a*, 8*b* may be threaded through the slots 12 in the same gripping device 10. In other example a gripping device 10' as shown in FIG. 2*c* may instead be used to fix the two end portions 8*a*, 8*b*. This gripping device 10' has a pair of cross-like slots 12 to separately grip the two end portions 8*a*, 8*b*. As will be described below, a gripping device 10, 10' that fixes both end portions 8*a*, 8*b* may also be used to connect them together and hold the support pillow 6 in a desired shape.

Figure 3A:
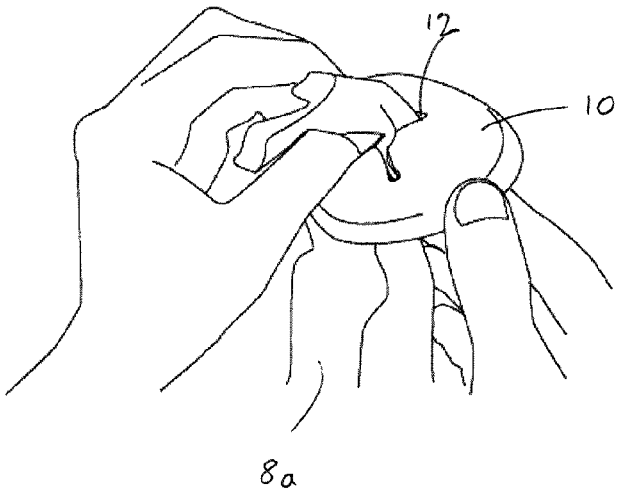
FIGS. 3*a* and 3*b* show the steps involved in using the gripping device of FIG. 2*b* to fix a free end portion.
Figure 3B:
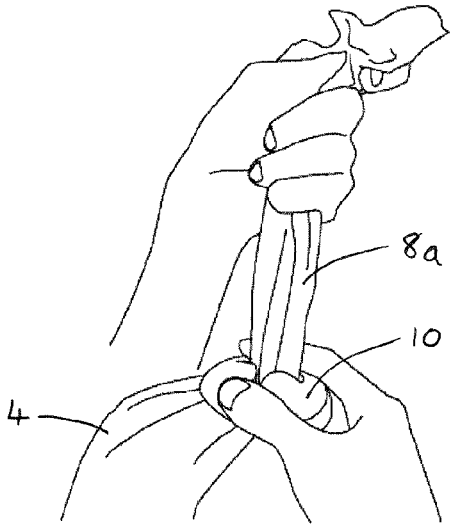

FIGS. 3*a* and 3*b* demonstrate how a free end portion 8*a* may be pulled through the slots 12 in a gripping device 10. The gripping device 10 can be moved along the free end portion 8*a* so as to tighten the outer sleeve 4 around an inner cushion. A user can position the gripping device 10 so as to determine how tightly or loosely the outer sleeve 4 encases the inner cushion, even compressing the inner cushion so as to hold it in a desired shape.

Figure 4:
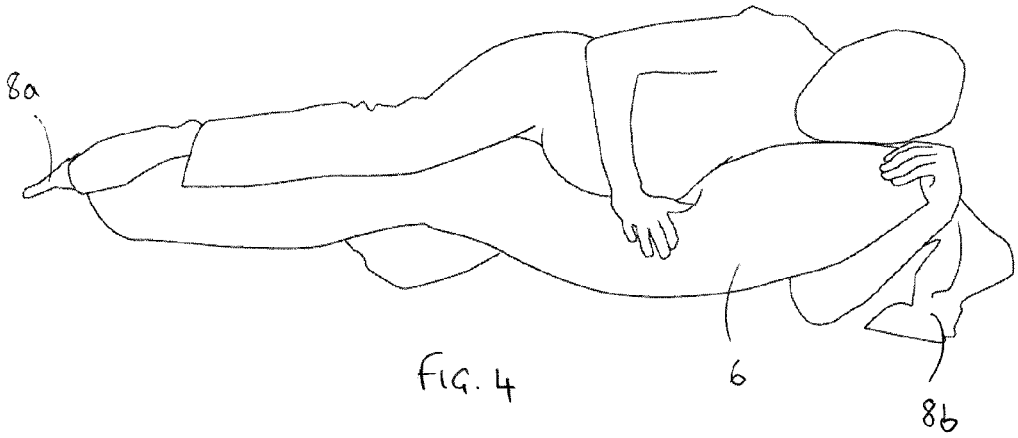
FIG. 4 is a schematic illustration of one use of the support pillow.

FIG. 4 provides one exemplary use of the support pillow 6, optionally after having fixed the free end portions 8*a*, 8*b* using a gripping device or other closure means. In this example the support pillow 6 retains a generally elongate shape so as to support a person along the length of their body as they are resting or sleeping, in particular a pregnant woman having a baby bump.

Figure 5A:
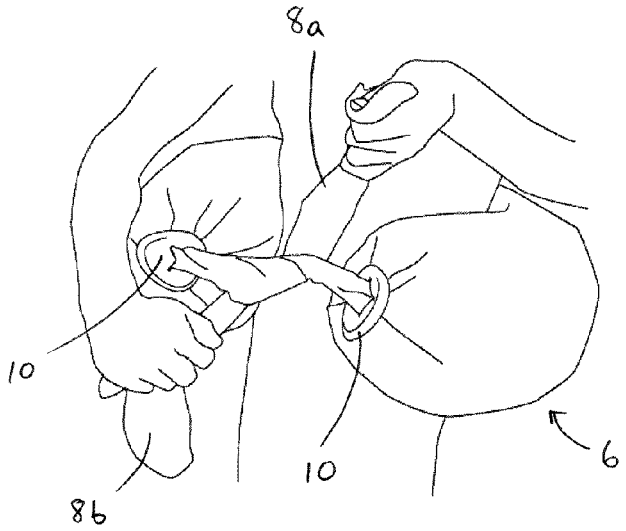
FIGS. 5*a* to 5*d* schematically illustrate how the free end portions may be tied together to fix the support pillow in a donut shape e.g. for use during breastfeeding.
Figure 5B:
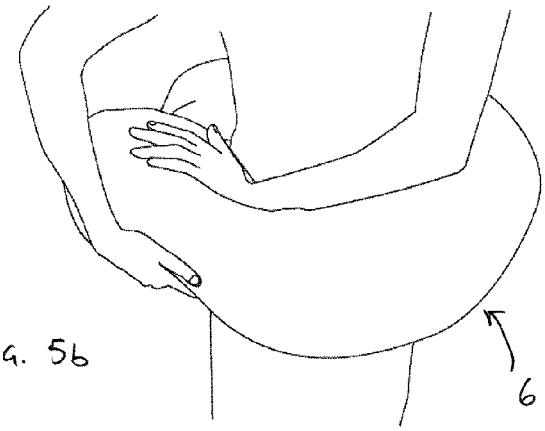
Figure 5C:
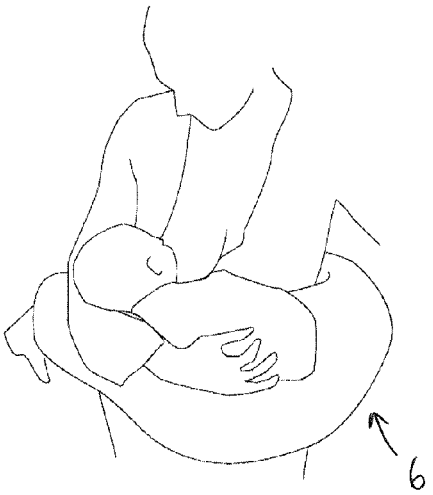
Figure 5D:
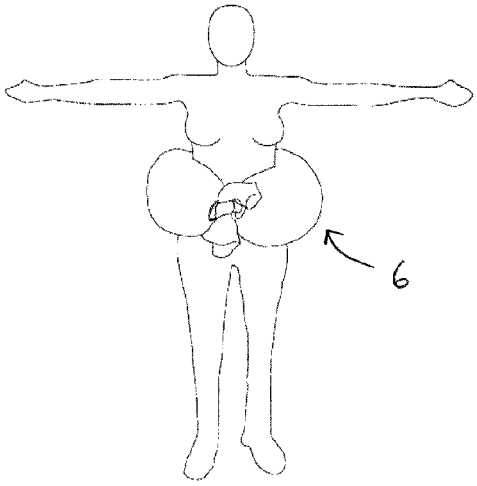

FIGS. 5*a* to 5*d* demonstrate how the free end portions 8*a*, 8*b* of a support pillow 6 may be tied together so as to fix the support pillow 6 in a desired shape, for example a donut shape around the torso of a user. FIG. 5*a* shows a user tying the two end portions 8*a*, 8*b* together. A pair of gripping rings 10 is optionally used to fix the lengths of the free end portions 8*a*, 8*b* before they are tied together. FIG. 5*b* shows a user adjusting the support pillow 6 once it has been fixed in a donut shape. It can be seen that even once the overall shape of the support pillow 6 has been fixed, it may be locally shaped by deforming the inner cushion so as to provide a desired outer contour. FIG. 5*c* shows the support pillow 6 in position around the torso of a woman while breastfeeding. FIG. 5*d* shows that the support pillow 6 can stay in position around the woman's torso so as to enable her to move around freely. Instead of tying the free end portions 8*a*, 8*b* together, they may be connected by any other means. For example, a gripping device 10, 10' as seen in FIG. 2*b* or 2*c* may be used to connect the two free end portions 8*a*, 8*b*. This means that a user may not need to tie a knot.

Figure 6A:
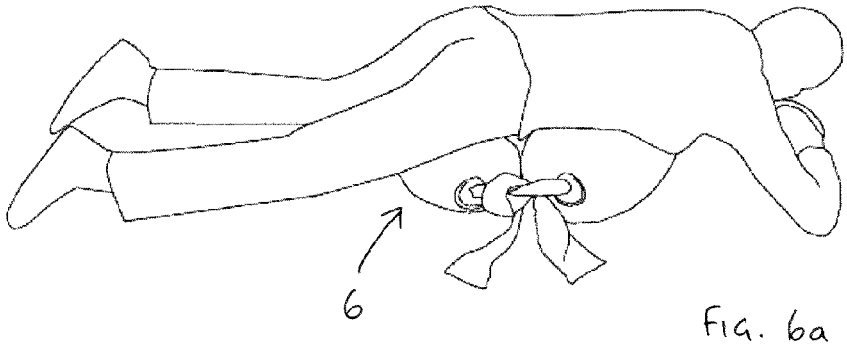
FIGS. 6*a* to 6*d* provide some further examples of the support pillow having different shapes for different uses.
Figure 6B:
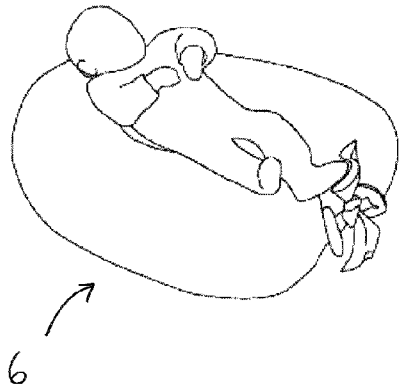
Figure 6C:
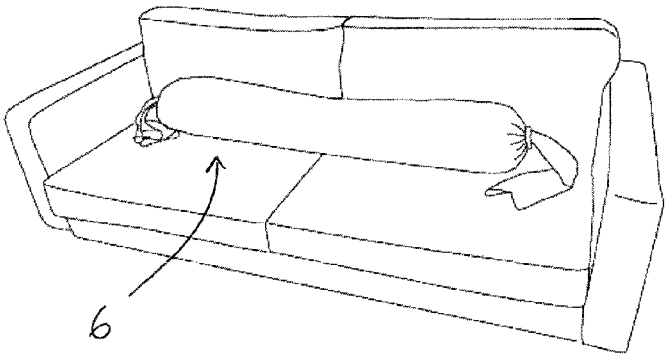
Figure 6D:
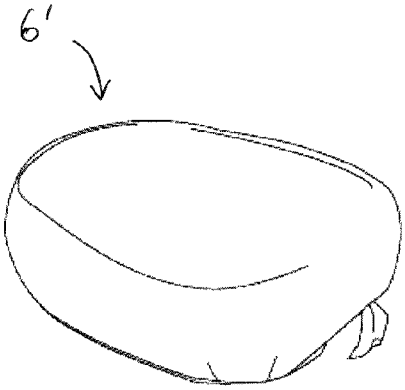

FIGS. 6*a* to 6*d* schematically show some alternative shapes and uses for a support pillow 6. In FIG. 6*a* the support pillow 6 is fixed in a generally annular e.g. donut shape and used as a belly support for a pregnant woman to rest or sleep on her front. In FIG. 6*b* the support pillow 6 is fixed in a horseshoe shape and used as a rest for a sleeping baby. In FIG. 6*c* the support pillow 6 has its free end portions pushed inside the outer sleeve, or else the outer sleeve is replaced with an alternative cover, so that the support pillow 6 can be used as a normal pillow on a couch. In FIG. 6*d* the support pillow 6' is no longer elongate an alternative outer cover has been used to contain the inner cushion and form a poof.

It should be apparent that the foregoing relates only to the preferred embodiments of the present application and the resultant patent. Numerous changes and modification may be made herein by one of ordinary skill in the art without departing from the general spirit and scope of the invention as defined by the following claims and the equivalents thereof.

We claim:

1. A support pillow comprising a flexible outer sleeve and a deformable inner cushion positioned wholly inside the outer sleeve, both the outer sleeve and inner cushion being elongate, wherein the outer sleeve is longer than the inner cushion and defines a pair of free end portions extending beyond the inner cushion, the inner cushion moveable inside the outer sleeve such that the length of each of the free end portions is adjustable, the free end portion extending far enough to enable a user to connect the end portions together to fix the support pillow in a desired shape, the support pillow further comprising a gripping device that can be moved along at least one of the free end portions to close the outer sleeve around the inner cushion and fix the length of the free end portion(s) extending beyond the inner cushion.

2. A support pillow according to claim 1, wherein the free end portions are long enough to enable a user to tie the end portions together.

3. A support pillow according to claim 2, wherein the free end portions extends beyond the inner cushion for a length of at least 10 cm.

4. A support pillow according to claim 1, wherein the inner cushion is removable from the outer sleeve.

5. A support pillow according to claim 1, wherein the outer sleeve takes the form of an open-ended tube.

6. A support pillow according to claim 1, comprising closure means to close the outer sleeve around the inner cushion and fix a length for each of the free end portions.

7. A support pillow according to claim 1, comprising a pair of gripping devices, each gripping device movable along the outer sleeve to independently fix the length of one of the free end portions.

8. A support pillow according to claim 1, wherein the gripping device is self locking.

9. A support pillow comprising a flexible outer sleeve and a deformable inner cushion positioned wholly inside the outer sleeve, both the outer sleeve and inner cushion being elongate, wherein the outer sleeve is longer than the inner cushion and defines a pair of free end portions extending beyond the inner cushion, and further comprising at least one gripping device movable along one or both of the free end portions to close the outer sleeve around the inner cushion and fix a length for the free end portions extending beyond the inner cushion.

10. A support pillow according to claim 9, comprising a pair of gripping devices, each gripping device movable along the outer sleeve to independently fix the length of one of the free end portions.

11. A support pillow according to claim 9, wherein the at least one gripping device is self-locking.

12. A support pillow according to claim 1, comprising constricting means positioned around the inner cushion.

13. A support pillow according to claim 12, wherein the constricting means is positioned to at least partially deform the inner cushion into multiple segments.

14. A support pillow according to claim 8, wherein the outer sleeve takes the form of an open-ended tube.

15. A support pillow according to claim 1, wherein the outer sleeve is made of flexible fabric material.

16. A kit further comprising a support pillow according to claim 1 and one or more further outer sleeves.

17. A kit according to claim 16, wherein at least one further outer sleeve is non-elongate.

18. A method of shaping a support pillow, the support pillow comprising a deformable inner cushion and a flexible outer sleeve, both the inner cushion and the outer sleeves being elongate, wherein the outer sleeve is longer than the inner cushion and defines a pair of free end portions extending beyond the inner cushion, the method comprising: moving the inner cushion movable inside the outer sleeve so as to adjust the length of each of the free end portion; and connecting the free end portions together to fix the support pillow in a desired shape.

19. A method according to claim 18, further comprising: selectively moving a gripping device along the outer sleeve so as to select a length of one of the free end portions.

* * * * *